US006976370B2

(12) United States Patent
Fiene

(10) Patent No.: US 6,976,370 B2
(45) Date of Patent: Dec. 20, 2005

(54) PORTABLE COOLER FOR BEVERAGE CONTAINER

(76) Inventor: Cory Fiene, 27766 Homestead Rd., Laguna Niguel, CA (US) 92677

( * ) Notice: Subject to any disclaimer, the term of this patent is extended or adjusted under 35 U.S.C. 154(b) by 0 days.

(21) Appl. No.: 10/363,348

(22) PCT Filed: Nov. 20, 2001

(86) PCT No.: PCT/US01/43507

§ 371 (c)(1),
(2), (4) Date: May 21, 2003

(87) PCT Pub. No.: WO02/42698

PCT Pub. Date: May 30, 2002

(65) Prior Publication Data

US 2004/0011076 A1 Jan. 22, 2004

Related U.S. Application Data

(60) Provisional application No. 60/252,528, filed on Nov. 22, 2000.

(51) Int. Cl.[7] ..... F25D 3/08
(52) U.S. Cl. ..... 62/457.4; 62/371; 62/530

(58) Field of Search ..... 62/457.2, 457.4, 62/371, 530

(56) References Cited

U.S. PATENT DOCUMENTS

| | | | | |
|---|---|---|---|---|
| 1,949,677 | A * | 3/1934 | Crawford | 383/96 |
| 3,998,072 | A * | 12/1976 | Shaw | 62/457.4 |
| 4,197,890 | A * | 4/1980 | Simko | 383/97 |
| 5,005,374 | A | 4/1991 | Spitler | 62/259.3 |
| 5,313,807 | A | 5/1994 | Owen | 62/457.3 |
| 5,555,746 | A | 9/1996 | Thompson | 62/457.4 |
| 5,564,583 | A | 10/1996 | Kelley et al. | 220/23.83 |
| 6,073,796 | A | 6/2000 | Mogil | 220/592.17 |
| 6,550,271 | B2 * | 4/2003 | Silbert | 62/457.4 |

* cited by examiner

*Primary Examiner*—Melvin Jones
(74) *Attorney, Agent, or Firm*—Rutan & Tucker, LLP

(57) ABSTRACT

A portable carrier for a beverage container includes a case (10) having an externally frusto-conical housing that fully encloses the beverage container, and a removable cooling core (70) that fits within the housing. A zipper (30) preferably extends along at least part of at least two sides of the case, and more preferably extends on the top and bottom of the case. A carrying strap (40) may include a pouch for storing a bottle opener.

9 Claims, 2 Drawing Sheets

PORTABLE COOLER FOR BEVERAGE CONTAINER

This application claims priority to PCT/US01/43507, filed Nov. 20, 2001, which claims priority to provisional application 60/252528, filed Nov. 22, 2000.

FIELD OF THE INVENTION

The present invention relates to the field of containers.

BACKGROUND OF THE INVENTION

There are numerous known devices for carrying and cooling beverage containers. In U.S. Pat. No. 3,998,072 to Shaw (December 1976) a portable wine cooler case has flasks of coolant that surround the body of a bottle. However, the case leaves the neck of the body unprotected. In other carrying cases such as U.S. Pat. No. 5,564,583 to Kelley et al. (October 1996), a cover does protect the neck of the beverage container, but the case does not conform to the shape of the neck. That leaves the carrying case unnecessarily bulky, and allows some types of bottles to shift unnecessarily within the case. Accordingly, there is still a need to provide improved beverage container carrying cases.

SUMMARY OF THE INVENTION

Methods and apparatus are provided in which a portable carrier for a beverage container includes a case having an externally frusto-conical housing that fully encloses the beverage container; and a removable cooling core.

Preferred embodiments include a zipper that preferably extends on at least part of at least two sides of the case, and more preferably extends on the top and bottom of the case. Preferred embodiments also include a carrying strap that may include a pouch for storing a bottle opener.

The present invention will become more apparent from the following detailed description of preferred embodiments of the invention, along with the accompanying drawings in which like numerals represent like components.

DETAILED DESCRIPTION

Figure 1:
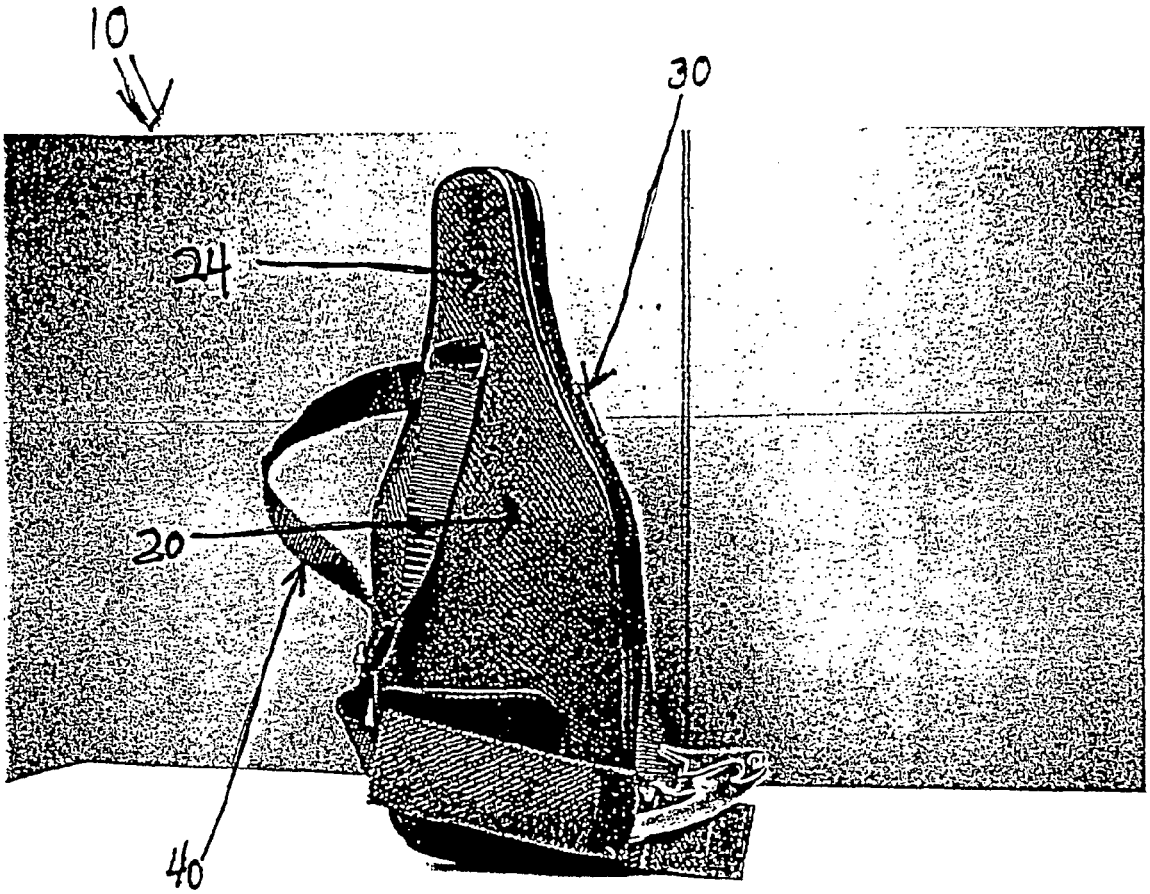
FIG. 1 is a side view of a preferred case in a closed position.

In FIG. 1, case 10 generally comprises a housing 20, a zipper 30, and a carrying strap 40.

The housing 20 has a generally frusto-conical external shape that accommodates a wine bottle. Housing 20 preferably comprises a water proof or water resistant fabric 24, but can be of any suitable material or have any suitable weave. Contemplated materials that can be used as part of, or in place of the fabric include canvas, nylon, cotton, plastic, polyester. The term "frusto-conical" is employed fairly loosely herein to cover all housings that generally have a tapered top section, and a more bottom section having a more constant cross-section. Thus, neither of those sections need to consistently curved on the outside, and may, for example, have six or eight sides, with soft or hard edges between adjacent sides. Within these broad bounds, alternative housings may have various slits, holes, as well as various shape modifications including protuberances, and the like.

The zipper in FIG. 1 extends on two sides of the case, the top, and the bottom. All other orientation and positions of zippers are also contemplated. Moreover, the zipper could be replaced by VELCRO™ or other closing apparatus.

The carrying strap 40 can be any suitable length, orientation, or material. In FIG. 1, an optional pouch contains an opener.

Figure 2:
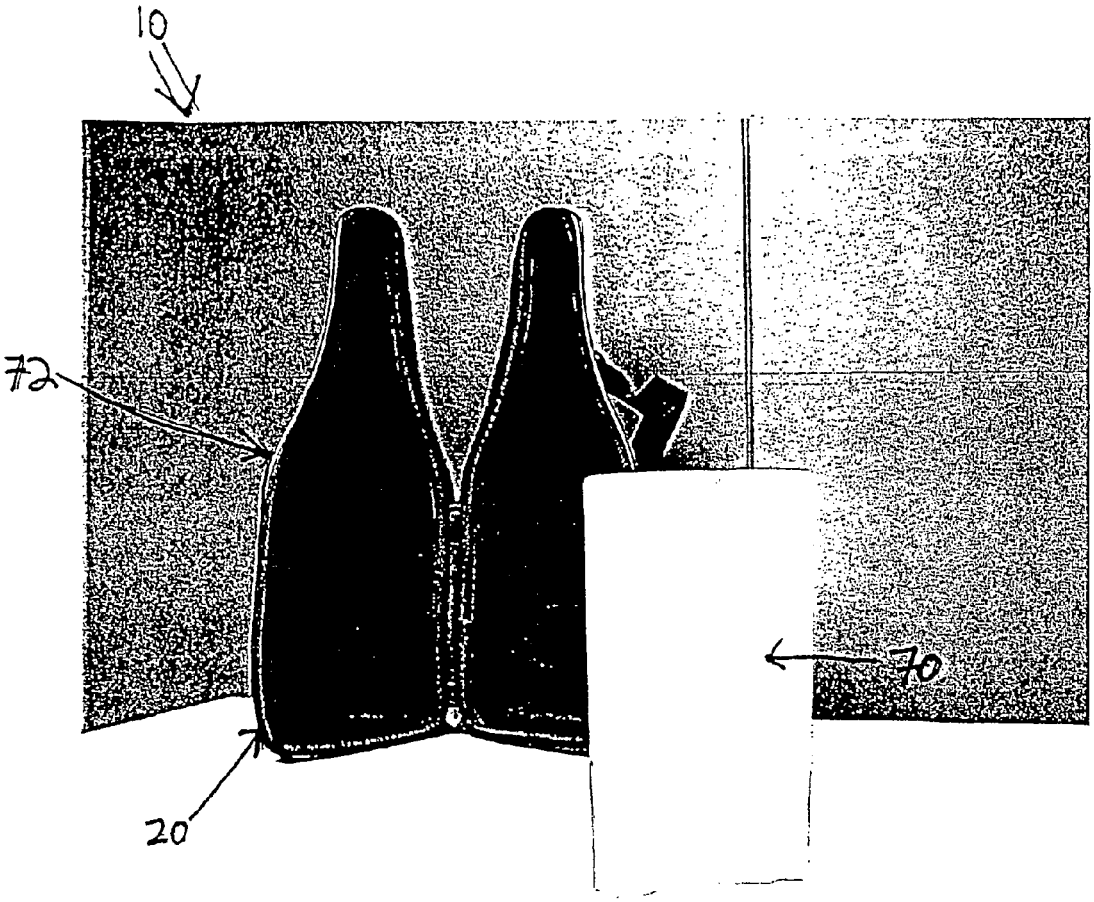
FIG. 2 is a perspective view of the case of FIG. 1, in an open position.

In FIG. 2, case 10 is in an open position, exposing the inside of the housing 20. A removable cooling core 70 is shown adjacent to the housing 20. In operation, the cooling core 70 is disposed in the base of the housing 20, and contains a wine bottle or other beverage container. A preferred material for cooling core 70 is ABS Plastic (Acrylonitrile Butadiene Styrene) with a glass bead finish to resist fingerprints. Colored plastic or marbleized colored plastic is used for additional appeal while the cooling core 70 is out of the housing 20. Cooling core 70 contains a material having high specific heat capacity, such as blue ice. The blue-ice is preferably filled to no more than about 70–80% capacity to allow for expansion when frozen.

In this instance the cooling core 70 has a base, and substantially cylindrical sides. The height is advantageously to within 1 inch of the shoulder 72 of the housing 20 to provide a large degree of cooling, while accommodating a large range of sizes of beverage containers. The cooling core 70 preferably contains "blue ice" or other coolant having a relatively high heat capacity. Other embodiments are also contemplated. For example, cooling cores (not shown) may be provided that have no base, or have internally or externally non-cylindrical sides. Relative to the shoulder 72, the height of the cooling core 70 may be shorter or taller than shown. The interior and exterior portions of the cooling core 70 may be cylindrical as shown, but may also independently have a rectangular, pentagonal, hexagonal, octagonal, or other cross-section.

Thus, specific embodiments and applications of portable carriers for beverage containers have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. A case for carrying a beverage container, comprising: (a) an externally frusto-conical housing having a main body that opens and closes to receive and fully enclose the beverage container; and (b) a removable cooling core having a cavity that receives a substantial portion of the beverage container, wherein the case has a zipper that opens and closes the main body to facilitate side loading of the beverage container.

2. The case of claim 1, wherein the zipper is part of at least two sides of the case.

3. The case of claim 1, wherein the zipper is on a top of the case.

4. The case of claim 1, wherein the zipper is on a bottom of the case.

5. The case apparatus of claim 1, wherein the case has a VELCRO™ coupler.

6. The case of claim 1, wherein the case further comprises a fabric.

7. The case of claim 1, wherein the case further comprises a carrying strap.

8. The case of claim 7, wherein a bottle opener is on the carrying strap.

9. The case of claim 1, wherein the removable cooling core is within 1 inch of a shoulder portion of the case.

* * * * *